United States Patent [19]

Aichinger

[11] 3,978,339

[45] Aug. 31, 1976

[54] REGULATING INSTALLATION FOR POWER TRANSMITTED TO A THREE-PHASE USER

[75] Inventor: Horst Aichinger, Furth, Germany

[73] Assignee: Siemens Aktiengesellschaft, Erlangen, Germany

[22] Filed: Jan. 13, 1975

[21] Appl. No.: 540,666

[30] Foreign Application Priority Data

Jan. 15, 1974 Germany ..... 2401774

[52] U.S. Cl. ..... 250/402; 250/408; 250/421; 315/194

[51] Int. Cl.[2] ..... H05G 1/30

[58] Field of Search ..... 315/194; 250/401, 402, 250/408, 409, 421

[56] References Cited

UNITED STATES PATENTS

| | | | |
|---|---|---|---|
| 1,957,226 | 5/1934 | Reid | 315/194 X |
| 2,193,649 | 3/1940 | Schmidt, Jr. | 315/194 X |
| 2,676,296 | 4/1954 | Kuntke | 250/421 |
| 3,636,355 | 1/1972 | James | 250/421 |

*Primary Examiner*—Craig E. Church
*Attorney, Agent, or Firm*—Haseltine, Lake & Waters

[57] ABSTRACT

A regulating installation for the power output conveyed to a three-phase user; including switches transmissive in both current directions having triggering characteristics, with the switches being positioned in two of the three power supply phases; first and second impulse generators; and an element transmitting a control signal to the impulse generators dependent upon the difference in the actual value and a reference value of the power output being regulated. Each of the impulse generators has, respectively, one switch associated therewith, the generators each being synchronized by a power supply phase and transmitting a triggering impulse to its associated switch. The first impulse generator is synchronized through a T-phase uninterruptedly applied to the user, and the second impulse generator is synchronized through an R-phase connected thereto by the switch associated therewith.

1 Claim, 10 Drawing Figures

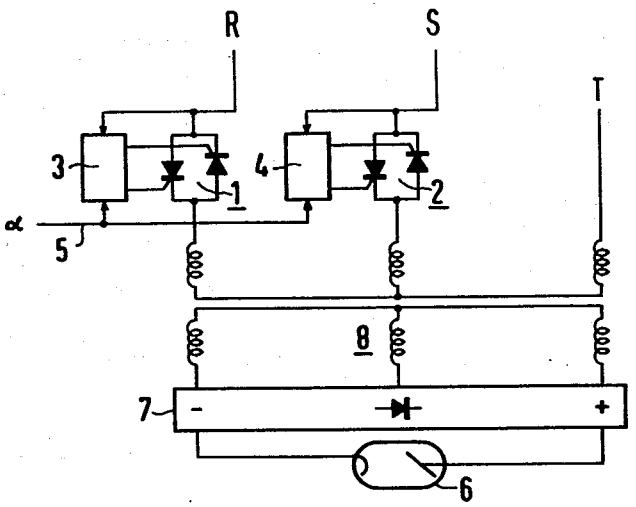
Fig.1
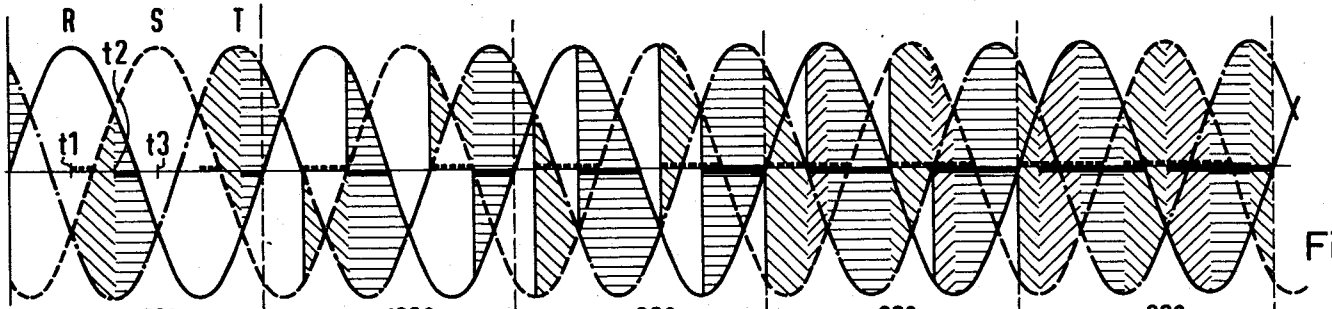
Fig.2
Fig.3

150° < α < 180°

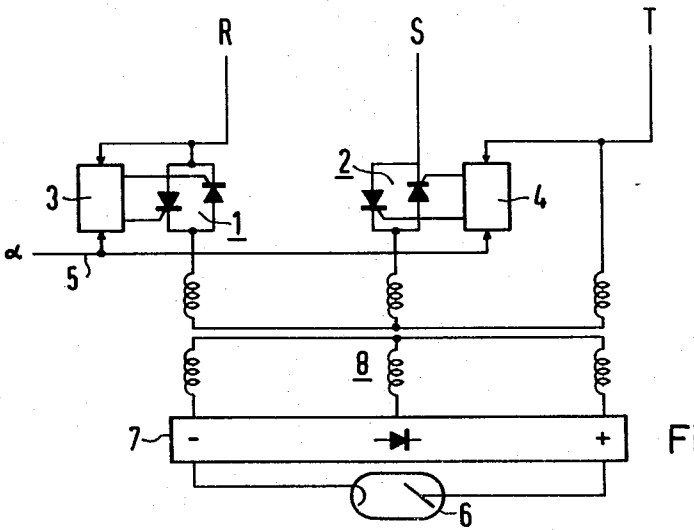
Fig.6
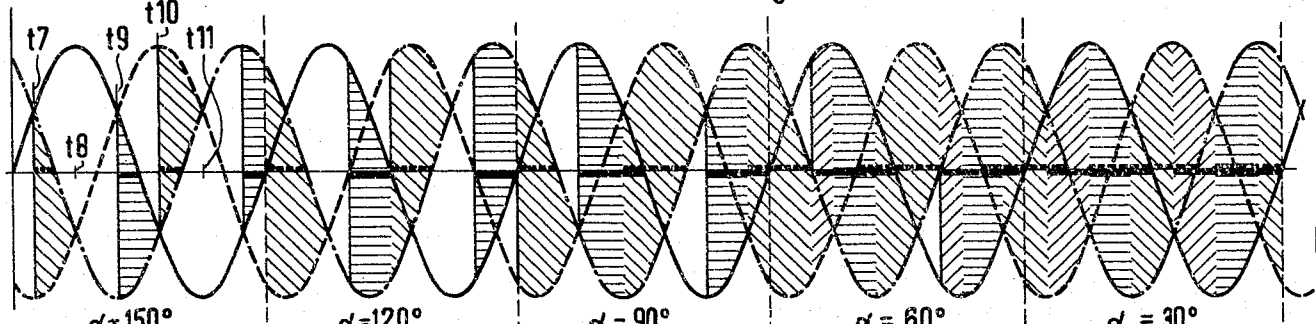
Fig.7
Fig.8

REGULATING INSTALLATION FOR POWER TRANSMITTED TO A THREE-PHASE USER

FIELD OF THE INVENTION

The present invention relates to a regulating installation for the power which is transmitted to a three-phase user or appliance.

DISCUSSION OF THE PRIOR ART

A three-phase alternating-current X-ray diagnostic apparatus which includes a regulating installation for the power transmitted thereto, and wherein two of the three power supply phases each incorporate a switch transmissive in both current direction with triggering characteristics; with an element which transmits regulating signals to two impulse generators dependent upon the difference between the actual and reference value of the power supply being regulated, of which one has associated therewith one of the switches and synchronized through intermediary of a power supply phase, and during each half-wave of its synchronizing power supply phase transmits a triggering impulse to the associated switch, whose commencement within the half-wave depends upon the regulating signal, is described in German Laid-Open Patent Specification 1,963,346 with respect to the control of the dosage output of the X-ray tubes. In this known apparatus, electronic switches having triggering characteristics are located in two of the three phases of the primary windings of the high-voltage transformer. Each of these switches has a trigger impulse generator associated therewith, which generates a trigger impulse for the switch within each period of the associated phase at an adjustable timepoint, which lasts until the initiation of the respectively following null or zero passage of the therewith associated phase voltage. A controller is present so as to provide for the adjustment of the duration of the triggering impulse, which is influenced by the deviation of the actual value of the dosage output from its reference value and by the reference value itself.

In the known X-ray diagnostic apparatus it is adequate that there are two switches in two phase of the primary winding of the high-voltage transformer since, in a three-phase system in which the primary windings of the high-voltage transformer form a Y-connection or star circuit, only load current may flow through the ungrounded star point when at least two phases carry a flow of current.

In the known X-ray diagnostic apparatus, the synchronization of the trigger impulse generators for the switches is carried out by means of those phases which are connected through the associated switches. Thus, for example, the trigger impulse generator for the switch in the S-phase is synchronized through the S-phase, and the trigger impulse generator for the switch in the T-phase is synchronized through the T-phase. There is thus initiated a triggering impulse within a half-wave of the phase voltage for the two connected phases at the same phase angle, as described in greater detail hereinbelow.

SUMMARY OF THE INVENTION

Accordingly, it is an object of the present invention to provide a regulating installation of the type described, in which there are eliminated control oscillations, and wherein the power output continually increases or reduces at an increasing or reducing triggering angle.

BRIEF DESCRIPTION OF THE DRAWINGS

Reference may now be had to the following detailed description of an exemplary embodiment of the invention, taken in conjunction with the accompanying drawings, in which:

FIG. 1 illustrates the essential components of an X-ray diagnostic apparatus constructed pursuant to the present state of the technology;

FIG. 2 graphically illustrates the primary voltage cycle of a high-voltage transformer;

FIG. 3 graphically illstrates the X-ray tube voltage cycle for the individual triggering angles;

FIG. 6 illustrates a circuit diagram constructed pursuant to the present invention;

FIG. 7 shows the power supply voltage cycle for the circuit in FIG. 6;

FIG. 8 graphically illustrates the synchronization of the trigger impulse generator;

DETAILED DESCRIPTION

Figure 4:
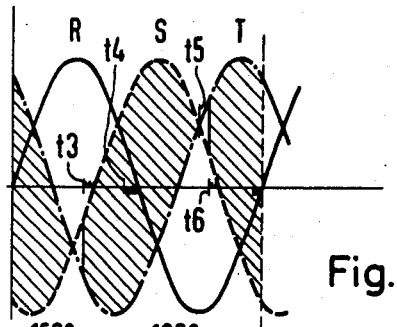
FIG. 4 illustrates the primary voltage cycle for the circuit diagram of FIG. 1.

Referring now in detail to the drawings, FIG. 1 shows the essential components of an X-ray diagnostic apparatus pursuant to the present state of the technology, in which, respectively, in each of the R-and the S-phases there is positioned a bipolor switch formed by two anti-parallel connected thyristors. The switch which is positioned in the R-phase is identified by reference numeral 1, and the switch in the S-phase by reference numeral 2. A control arrangement 3 is associated with switch 1 and a control arrangement 4 with switch 2 as trigger impulse generators. The control arrangement 3 is synchronized through intermediary of the R-phase, and the control arrangement 4 through intermediary of the S-phase. Both of the control arrangements 3 and 4 have a signal transmitted thereto by means of the connector 5, which characterizes the triggering angle, in effect, meaning of the initiation of a triggering impulse within a half-wave of the phase synchronizing the particular control arrangement. An X-ray tube 6 is powered through a high-voltage rectifier 7 from a high-voltage transformer 8 which is connected to the switches 1 and 2. The phase T is directly connected to the high-voltage transformer 8.

In FIG. 2 of the drawings there is graphically illustrated the cycle of the primary voltage of the high-voltage transformer 8. The phase R thereby is shown as drawn is solid lines, the phase S in dashes, and the phase T in chain-dotted lines. By means of dashes and completely solidly drawn straight lines there is illustrated in FIG. 1 for the phases R and S within each half-wave, that particular range within which, for the various triggering angles, there is applied a triggering impulse to one of the thyristors of both switches 1 and 2. The triggering of one of these switches is always effected within an angular range of between 30° and 150° for the initiation of a triggering impulse, whereas the switch is cut off when its current passes through zero, or when the load current is assumed from the other switch upon its triggering. In accordance therewith, for example, at a triggering angle of 150° the switch 2 is triggered from the timepoint *t*1 up to the timepoint *t*2. At timepoint *t*2, the switch 1 is triggered and operative up to timepoint *t*3. From FIG. 2 there are ascertained the time periods for the further triggering angles within which the switches 1 and 2 are triggered.

FIG. 3 illustrates the X-ray tube voltage for the individual triggering angles, wherein, for purposes of simplicity, a translational ratio of 1 : 1 has been basically assumed for the high voltage transformer 8. The X-ray tube voltage is obtained from difference between the phase voltage which lies across the presently conductive thyristor at the primary winding of the high voltage transformer 8, and the phase voltage T. In FIG. 2 the voltage range within which this difference must be formed is characterized for the switch 1 by means of the horizontal cross-hatching, and for the switch 2 by means of the sloped cross-hatching. Hereby there is to be particularly formed the difference between one of the phase voltages R and S, and the phase voltage T.

From FIG. 3 there may be ascertained that the X-ray tube voltage reduces with respect to its effective value from a triggering angle of 30° to an ignition angle of 150°, so that the dosage output also thus continuously reduces within this range. From FIG. 3 there may, however, also be ascertained that at some triggering angles, the peak value of the X-ray voltage is not constant.

FIG. 4 shows again the primary voltage cycle for the circuit arrangement according to FIG. 1, however, at the assumption that the triggering angle is located between 150° and 180°. In accordance therewith, the triggering impulse for switch 2 commences, for example, at timepoint *t*3, and the triggering impulse for the switch 1 at timepoint *t*4. The X-ray tube voltage again, under the assumption of a translational ratio of 1 : 1 for the high-voltage transformer 8, corresponds to the differential voltage (chain-illustrated voltage) between the S-and and T-phase when the switch 2 is triggered, and between the R-and the T-phase when the switch 1 is triggered. At timepoint *t*4, the switch 1 cannot, however, assume the load current, from which there may be ascertained that, at timepoint *t*4, the voltage at the triggered thyristor of the switch 1 is less than the voltage at the triggered thyristor of the switch 2. The last-mentioned thyristor thus is further actuated up to the timepoint *t*5 at which its current passes through zero and there is no longer present a triggering impulse at the trigger electrode, so as to be cut off. At timepoint *t*6 there is then again triggered a thyristor of the switch 2.

Figure 5:
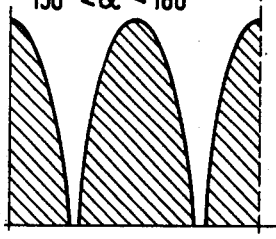
FIG. 5 illustrates the X-ray tube voltage cycle.

From FIG. 4 there may thus be ascertained, that the switch 1 can never assume the load current within a range of 150° to 180° for the triggering angle. The X-ray tube voltage is again obtained from the difference of the voltage between that particular phase which is connected through to the high-voltage transformer 8, and the T-phase; it is accordingly, obtained from the difference between the voltage at the S-phase and at the T-phase during those time periods within which the switch 2 is actuated. The foregoing cycle is illustrated in FIG. 5 of the drawings. A comparison between FIG. 3 and FIG. 5 indicates, that the effective value of the X-ray tube voltage drops off from a triggering angle of 30° towards a triggering angle of 150°, and again increases from a triggering angle of 150° to a triggering angle of 180°. The control range thereby lies between 30° and 180°. From the foregoing there is ascertained that the controller for effecting the dosage output regulation, of which the components 1 through 4 form elements thereof, tends towards oscillating, so that there may occur control oscillations. This controller or regulator consists of a measuring element for the actual value of the dosage output, a reference value indicator for the dosage output, a comparator element for the actual-and the reference values and the components 1 through 4, so as to generate a signal in the conductor 5 which varies for a deviation of the actual value from the reference value, and maintains its magnitude when the actual value is equal to the reference value (PI-regulator).

Reference may now be had to FIGS. 6 through 8 illustrative of various characteristic details of the present invention.

The construction components of FIG. 6 essentially correspond to the elements shown in FIG. 1. The difference between FIG. 6 and FIG. 1 is, however, that the triggering impulse generator, 4 is not synchronized through the S-phase, but rather through the T-phase.

In FIG. 7 there is again represented the power supply voltage and the straight chain-lines show these time periods during which, for the various triggering angles, there are applied triggering impulses to the switch 2, while the full solidly shown lines indicate those time periods during which the triggering impulses are applied to the switch 1. The X-ray tube voltage again is obtained from the voltage difference between the two phases, which are presently connected to the high-voltage transformer 8. The ranges which this differential voltage must be formed are again characterized by means of the horizontally cross-hatched and sloped cross-hatched areas in FIG. 7. At a triggering angle of 50°, one of the thyristors of switch 2 is triggered, for example, between timepoints *t*7 and *t*8. Between timepoints *t*9 and *t*10 there is triggered one of the thyristors of switch 1. At timepoint *t*10 the load current is again assumed by one of the thyristors of the switch 2, and the last-mentioned thyristor remains active up to timepoint *t*11. For the further illustrated triggering angles, the actuated periods may similarly be ascertained from FIG. 7.

From FIG. 8 there may be ascertained that when the synchronization of the triggering impulse generator 3 is maintained by means of the R-phase, but the triggering impulse generator 4, which is associated to the switch 2 in the S-phase, is synchronized through the T-phase, the dosage output continually increases from the smallest triggering angle to the largest triggering angle over the entire range of the triggering angle, within which it is possible to effect regulating of the dosage output. Control oscillations are thereby precluded. Furthermore, there may be ascertained from FIG. 8 that, at a predetermined triggering angle, the peak value of the X-ray tube voltage is always equal, which also aids in the stabilization of the regulation.

The above assumptions with respect to the triggering time points and the X-ray tube voltage are only valid when the inductivities may be neglected and, consequently, there does not occur a phase displacement between the primary load current and the phase voltage. This precondition is fulfilled in a three-phase alternating current X-ray diagnostic apparatus.

In summation, it is thus ascertained that, for a three-phase alternating current X-ray tube diagnostic apparatus which is constructed according to German Laid-Open Specification No. 1,963,346, there may be prevented a stabilization of the dosage output regulation and the occurrence of control oscillations in conformance with the present invention, when one of the two triggering impulse generators for the two bipolar switches located in the two phases of the feed connectors for the high-voltage transformer is synchronized through the corresponding phase of the associated bipolar switch, and the other triggering impulse is synchronized through phase which is uninterruptedly applied to the high-voltage transformer. Within the scope of the invention it is also possible that, in FIG. 6, the triggering impulse generator 4 is synchronized through the S-phase, and the triggering impulse generator 3 through the T-phase.

Figure 9:
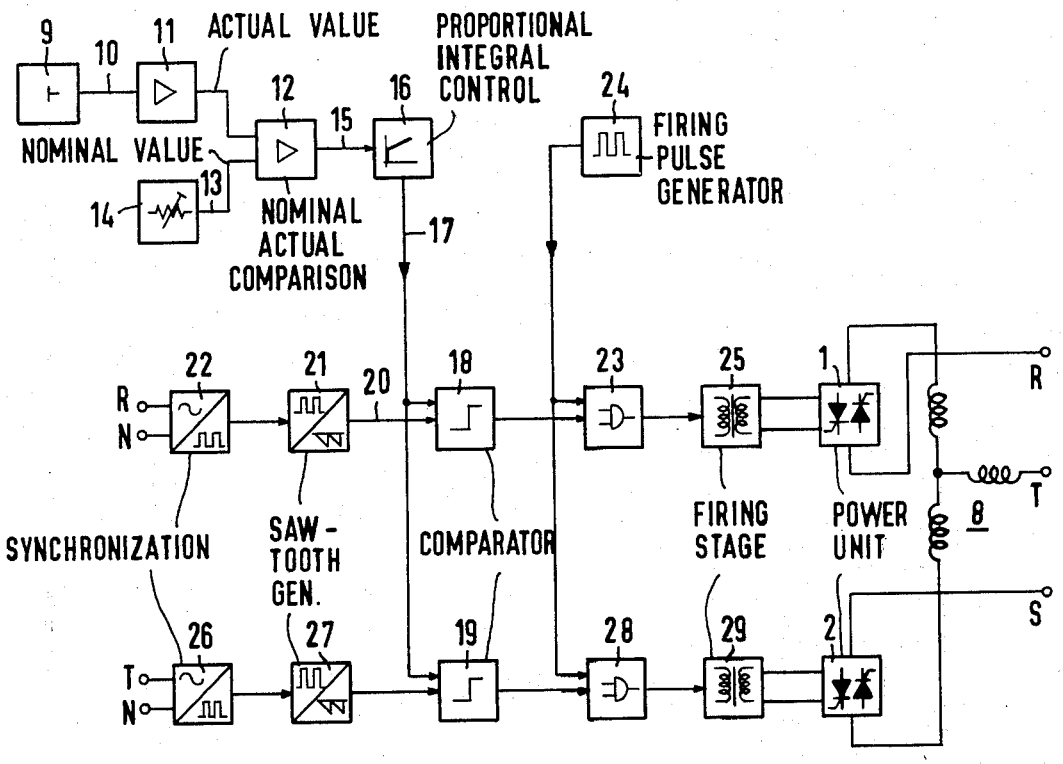
FIG. 9 illustrates in detail the construction of the trigger impulse generators.

The construction of the triggering impulse generators 3 and 4 may be ascertained in greater detail from FIG. 9. Thus, in FIG. 9 there is illustrated a detector 9 which detects the radiation from the X-ray tube 6, and delivers a signal at its output 10, which corresponds to the dosage output. After amplification in amplifier 11, this signal is transmitted to a comparator 12 as the actual value for the dosage output. The reference value input 13 of the comparator 12 has transmitted thereto from a reference value transmitter 14 a reference value representative of the dosage output. At the output 15 of the comparator 12 a signal lies which corresponds to the difference between the actual and reference value of the dosage output, and which controls a proportional-integral-regulator or controller 16. The signal at the output 17 of the proportional-integral-regulator 16 remains constant as long as no signal at its input and varies when the actual value deviates from the reference value of the dosage output and there is provided thereby an input signal at the input of the proportional-integral-regulator 16.

The output signal of the proportional-integral-regulator 16 is transmitted to two comparatos 18 and 19, of which the comparator 18 is associated with the phase R, and the comparator 19 with the phase T. A second input 20 of the comparator 18 has a signal transmitted thereto from a saw-tooth generator 21. The saw-tooth generator 21 is controlled by means of synchronizing installation 22. The output signal of the comparator 18 is conveyed to an AND-gate 23, whose second input receives the output signal from a triggering impulse generator 24. By means of triggering firing-stage 25, there are controlled the thyristors of the switch 1.

In a similar, a synchronizing installation 26 for the phase T controls a saw-tooth generator 27. The comparator 19, which is controlled by the output signal of the saw-tooth generator 27 and the proportional-integral-regulator 17, has an AND-gate 28 connected thereto which controls a triggering firing-stage 29 which is associated with the thyristors of the switch 2.

The synchronizing installations 22 and 26, at each null or zero pass of the associated phase, deliver a small square-wave impulse which is transformed into a saw-tooth impulse in the saw-tooth generators 21 and 27. Each output signal of the saw-tooth generators 21 and 27 thus commences at the zero passage of the associated phase and terminates at the subsequent zero passage. The comparators 18 and 19 deliver output signals when the saw-tooth impulses reach the signal at the output 17 of the proportional-integral-regulator, and through the AND-gates 23, 28 effect connection of the triggering impulse generator 24 to the firing-stages 25 and 29 so as to trigger the thyristors of the switches 1 and 2. It is ascertained that the timepoint within a half-wave of the phases R and T, within which there are triggered the thyristors of the switches 1 and 2, depend upon the output signal of the proportional-integral-regulator 16. When the actual value of the dosage output is equal to the reference value, then this timepoint remains unchanged. If an output signal appears at the output 15 of the comparator 12, then this timepoint is displaced in the context of correlating the actual value of the dosage outputs to the reference value.

From FIG. 9 there may be clearly ascertained that the synchronization of the triggering installation of switches 1 and 2 is carried out through the phases R and T, and that the phase T is connected directly to the primary winding of the high-voltage transformer 8, whereas the phases R and S are conducted through the switches 1 and 2.

Figure 10:
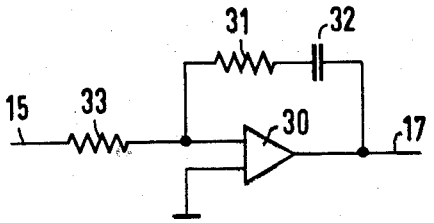
FIG. 10 illustrates the circuitry of an operational amplifier employed in FIG. 5.

The proportional-integral-regulator 16, in accordance with FIG. 10, includes an operational amplifier 30 which is connected in feedback relationship through an RC-element 31, 32, and consequently delivers an output signal which maintains its present value when the input signal transmitted to a coupling resistance 33 is zero, and whose value varies when the input signal deviates from zero.

The invention is not limited to an X-ray diagnostic apparatus but is generally suitable for the power output regulation of any three-phase alternating current user or appliance.

While there has been shown what is considered to be the preferred embodiment of the invention, it will be obvious that modifications may be made which come within the scope of the disclosure of the specification.

What is claimed is:

1. A regulating installation for the controlling power conveyed to a three-phase user, said installation comprising an X-ray diagnostic apparatus having an X-ray tube; a three-phase high-voltage transformer having three primary power windings; switch means transmissive in both current directions having triggering characteristics, respectively one of said switch means being positioned in each of two of the three power supply phases; first and second impulse generators; an element transmitting a control signal to said impulse generators upon the difference in the actual value and a reference value of the X-ray dose produced by said X-ray tube; each of said impulse generators controlling, respectively, one said switch means, said generators each being synchronized with a power supply phase and transmitting a triggering impulse to the respective switch means during the half-wave of its synchronizing power supply phase, the initiation of said triggering impulse within said half-wave being dependent upon said control signal, the improvement comprising: means connecting said first impulse generator to the one of said three transformer phases that does not have one of said switch means connected thereto so as to synchronize said first impulse generator with the phase that is uninterrupted by any of said switch means and means connecting said second impulse generator to the same phase that contains the switch means that are controlled by said second impulse generator so as to synchronize said second impulse generator with the phase containing the switch means that it controls.

* * * * *